US007260961B1

(12) United States Patent
Kennedy

(10) Patent No.: US 7,260,961 B1
(45) Date of Patent: Aug. 28, 2007

(54) CIRCULARLY KNIT UNDERGARMENT HAVING KNIT-IN SUPPORT PANELS AND DERRIERE CUP FULLNESS

(76) Inventor: Amanda Kennedy, 944 Harbor Crossing La., Marina del Ray, CA (US) 90292

( * ) Notice: Subject to any disclaimer, the term of this patent is extended or adjusted under 35 U.S.C. 154(b) by 0 days.

(21) Appl. No.: 11/592,492

(22) Filed: Nov. 2, 2006

(51) Int. Cl.
*D04B 9/00* (2006.01)

(52) U.S. Cl. ..... 66/177; 66/171

(58) Field of Classification Search ..... 66/170, 66/171, 175, 176, 177, 178 A
See application file for complete search history.

(56) References Cited

U.S. PATENT DOCUMENTS

| | | | | |
|---|---|---|---|---|
| 3,413,824 A | | 12/1968 | Kuney | |
| 3,625,029 A | * | 12/1971 | Safrit et al. | 66/142 |
| 5,590,548 A | | 1/1997 | Osborne | 66/177 |
| 5,787,732 A | * | 8/1998 | Perron et al. | 66/177 |
| 5,954,564 A | * | 9/1999 | Ganz | 450/99 |
| 5,996,120 A | * | 12/1999 | Balit | 2/67 |
| 6,119,491 A | * | 9/2000 | Pinelli | 66/177 |
| 6,192,717 B1 | | 2/2001 | Rabinowicz | 66/177 |
| 6,874,337 B2 | * | 4/2005 | Uno et al. | 66/177 |
| 7,024,892 B2 | * | 4/2006 | Blakely | 66/177 |

* cited by examiner

*Primary Examiner*—Danny Worrell
(74) *Attorney, Agent, or Firm*—Rashida A. Karmali

(57) ABSTRACT

This invention discloses circularly knit undergarments, said under garments having an anterior tummy region, a posterior stretching from the waist to the gluteal region, and two outer-regions corresponding to the outer thigh region, each of said regions includes knit-in support panels to minimize appearance of undesirable bulges. The posterior region further includes a plurality of derriere cups to slim and shape the lower half of the body to a younger tone and to provide a natural appearance to the derriere, hips and tummy. In a preferred embodiment the body of the undergarment is made with material that is seamlessly woven, for example, light weight micro fiber nylon or LYCRA spandex, and includes a gusset that is made of cotton and micro fiber nylon to prevent moisture build up between the legs. The under garments are finished in ribbing located at their terminal ends. In addition to providing an overall slimming and reshaping of the lower body part, the unique knitting technique and the derriere cups in the posterior of the under garment provide the wearer comfort, a rounder natural look to the buttocks, and a psychological boost.

5 Claims, 4 Drawing Sheets

CIRCULARLY KNIT UNDERGARMENT HAVING KNIT-IN SUPPORT PANELS AND DERRIERE CUP FULLNESS

1. FIELD OF INVENTION

This invention discloses circularly knit undergarments, said undergarments having a plurality of knit-in support panels in the anterior tummy region, in the posterior hip region from the waist to the gluteal region, and in the two outer-regions corresponding to the outer thigh regions. In particular, the support panels are strategically located to minimize appearance of undesirable bulges, and to provide a smooth and sexy look accompanied with comfort and a psychological boost without having to resort to extreme diets that often result in eating disorders. The posterior region further includes a plurality of derriere cups to slim and shape the lower half of the body to a younger tone and to provide a natural appearance to the derriere, hips and tummy. Optionally, the cup feature may be applied in the front portion of a panty for a pregnant woman. In a preferred embodiment, the body of the undergarment is made with material that is seamlessly woven, for example, light weight microfiber nylon and LYCRA® spandex to provide comfort and strength, and further includes a gusset that is made of cotton and microfiber nylon to prevent moisture build up between the legs. The under garments are finished with a band that causes no compression or rollup with ribbing located at their terminal ends.

2. BACKGROUND TO THE INVENTION

There has been continuing interest in the apparel industry to develop undergarments that provide a sliming and shaping effect in the lower half of the body such as hips, tummy and thighs. The earliest form of lower body garment used for controlling and minimizing the appearance of body bulges was the girdle. However, the traditional girdle is made of heavy fabric and requires seaming of individual panels and can have a rubberized feeling next to a wearer's skin, and is uncomfortable and hot.

U.S. Pat. No. 3,413,824 to Kuney discloses knitted garments which include form-fitting pockets in order that they can accentuate specific portions of the body. The girdle is knitted using a constant knit structure, with the stitch length being varied in selected areas to form spaced concave areas which are to correspond to specific regions of the wearer's body. However, the two concave areas in the girdle described in this patent are separated by tightly knit seamed pieces that create discomfort and might be unsightly under a wearer's clothes. The garment in the shape of a girdle, also makes the wearer feel hot and uncomfortable. It also has the disadvantage of squeezing the two buttocks together into one large unattractive mass instead of separating the buttocks and making them look more round and natural.

U.S. Pat. No. 5,590,548 to Osborne describes a legged panty having strategically located support panels for minimizing the appearance of undesirable body bulges along a wearer's stomach, hips and thighs, and the panty includes a U-shaped or anchor shaped support panel about the gluteal crease in order to provide support for the buttocks, and additional yarn provides added fabric fullness to the buttock cheeks. The design includes a substantially anchor-shaped support panel extending vertically through the center of the rear portion and curving around toward and along a portion of the first and second leg portions in order that it conforms to the regions of a wearer's body corresponding to the areas between and beneath the wearer's buttock cheeks. In other words, the garment smashes the buttocks together and gives the appearance of one large undifferentiated, unattractive and unnatural gluteal mass.

U.S. Pat. No. 7,024,892 to Blakely describes an undergarment in which the legs of the undergarment are free of bottom leg bands, with each of the legs of the undergarments is formed as a seamless two-ply fabric tube having a tubular inner ply and a tubular outer ply, the two plies being connected to each other by being knit to each other at the bottom edge of the leg, and therefore the legs are free of separately formed and attached bottom leg bands. The main disadvantage of the garment described is that the enhanced body shaping is provided for the abdominal region using a tighter knit than in the rear part of the panty, thus making the rear part longer than the front part. This design still smashes or squeezes the buttocks together and the unnatural appearance of one large undifferentiated buttock mass clearly indicates to an observer that the wearer is using a body slimming garment.

Yet an additional disadvantage of the under garments described in the prior art is the use of waist bands with compressive elastic that pinches or makes the flesh protrude above the band.

The above disadvantages have been overcome in the present invention.

3. SUMMARY OF THE INVENTION

An object of the present invention is to provide a circularly knit garment with a first knit-in support panel in the anterior region that compresses and firms the tummy, and on either side of the first support panel extending into second and third support panels designed to support the thigh regions. In a preferred embodiment of the invention, the body of the panty comprises the legs formed of material that is seamlessly woven light weight microfiber nylon and LYCRA® spandex. The second and third support panels are integrally knit to the first support panel using a different strength of weave, to a ribbing pattern. In addition, a fourth support panel is knit integrally at the lower end of the first support panel and extends to the crotch area.

Another object of the present invention is to provide a circularly knit garment with an anchor-shaped fifth knit-in support panel in the posterior region that compresses and firms the hip region from the waist down to the gluteal mound and extending on either side into meet the second and third support panels designed to support the thigh regions. A sixth knit-in support panel extends from the fifth panel in the region of the gluteal mound to the gluteal crease to create strategically placed left and right derriere cups made of a jersey knit material to accommodate the two buttock cheeks. At the lower rim of the derriere cups is included a seventh knit-in support panel that circularly frames the buttock region and supports, separates, lifts and firms the buttocks to shape the buttock into a natural round shape.

Another object of the present invention is to provide a circularly knit garment with knit-in support panels in the anterior, posterior and outer region of the thighs that minimize wiggle when walking without creating any panty lines.

These and other objects are accomplished through the provision of circularly knit garments, including, but not limited to panties, shorts, pants, capris, slips, body suits, leggings or panty hose, said undergarments having a plurality of knit-in support panels strategically knit in the tummy region, the hip region and in the outer thigh region. The term 'panty' as used herein, refers to articles of apparel listed above, which are used to clothe the lower portion of a person's body, between the waist and thighs, a portion of which extends between a wearer's legs, which in some embodiments, includes portions of the leg. Though particularly intended for wearing under other clothing, the circularly knit garments according to the present invention can be worn as outer garments as well. In addition, the garments may be worn by males and females, adults and children alike, and may be specifically configured to fit specific sex or age of the wearer, such as providing a breathable gusset for women's panty version or a supplemental crotch portion on men's panty version. Not to leave out pregnant women, a special panty version may be structured with a cup in the front portion to accommodate and support the enlarging stomach.

A panty according to the present invention includes a cylindrical fabric portion having at its upper edge a panty waist band and a circular body portion knit integrally to said waist band. For descriptive purposes the body portion includes the anterior and posterior regions which are integrally knit together along the first and second side regions. It should be understood however, these sections are all part of the circularly knit body portion, and are referred to herein as separate regions only in order that the location of various elements can be illustrated.

The body portion of the panty is knit with material that is seamlessly woven with material that is light weight microfiber nylon and LYCRA® spandex to provide comfort and strength.

A plurality of support panels are integrally knit into the body portion with the knit structure of the support panels being modified from the rest of the panty so that the support panels have a customized resistance to strength that is different from the remainder of the panty body portion. A particularly preferred embodiment includes a circularly knit garment with a first knit-in support panel in the anterior region being shaped and positioned to correct the tummy region of a wearer of a panty by heavy compression without creating a shift of the undesirable bulging to the waist region and above the panty band.

In another preferred embodiment, a set of second and third side knit-in support panels are integrally knit to either side of the first support panel using a different ribbing pattern weave, such that the second and third panels extend in a lateral direction along opposite sides of the first support panel. In this way, the second and third support panels overlie the outer hips and thighs or saddlebag regions of the wearer's body, thereby controlling undesirable bulging in these conventionally bulge-prone areas. In addition, the invention includes a fourth support panel knit integrally at the lower end of the first support panel and extending to the crotch area. The fourth support panel provides support and smoothness for the lower tummy area.

In yet another embodiment, the invention includes an anchor-shaped fifth knit-in support panel in the posterior region of a wearer, said fifth support panel being positioned and structured to compress and firm the hip region from the waist down to the gluteal mound. The fifth knit-in support extends on either side into a ribbing knit pattern to meet the second and third knit-in panels (from the anterior region) designed to support and compress the saddlebag regions of the wearer's body in the thigh regions.

In a particularly preferred embodiment of the invention, the circularly knit garment includes a sixth knit-in support panel integrally knit from the fifth knit-in support panel and extending to the gluteal crease to create strategically placed left and right derriere cups which are made of a jersey knit material to flexibly accommodate the two buttock cheeks. The sixth knit-in support panel uniquely extends vertically through the center of the posterior region and curves around toward and along a portion of the first and second buttock cheeks in order that it conforms to the regions of a wearer's body corresponding to the areas between and beneath the wearer's buttock cheeks thereby providing a natural, rounder, firmer and sexy appearance to the derriere instead of giving the appearance of one large undifferentiated mass of buttocks smashed together as described for garments disclosed in prior art.

In addition, the lower ends of the derriere cups are framed by a seventh knit-in panel that circularly frames, separates and firms the buttock cheeks into naturally round and youthful shape. Preferably, a separate gusset portion is sewn into the panty portion between the two halves of the panty. The body of the panty is made with material that is seamlessly woven, for example light weight microfiber nylon and LYCRA® spandex to provide comfort and strength. The gusset portion is made of cotton and microfiber nylon to prevent moisture build up between the legs. The panty thigh and leg portions are made of a lighter knit and are finished with a band that causes no compression or roll up in the terminal ends of the panty.

4. BRIEF DESCRIPTION OF FIGURES

A better understanding of the present invention may be obtained from the following detailed description of the preferred embodiments described in connection with the accompanying drawings wherein.

5. DETAILED DESCRIPTION OF THE INVENTION

The present invention will now be described more fully hereinafter with reference to the accompanying drawings, in which preferred embodiments of the invention are shown. The invention may however, be embodied in many different forms and should not be construed as limited to the embodiments set forth herein. Rather, these embodiments are provided so that this disclosure will be thorough and complete, and fully convey the scope of the invention to those skilled in the art. Like numbers refer to like elements throughout.

FIGS. 1 through 4 depict embodiments of the invention as applied to panties, shorts, pants, capris, slips, body suits, leggings or panty hoses or similar types of lower-body undergarments.

Figure 1:
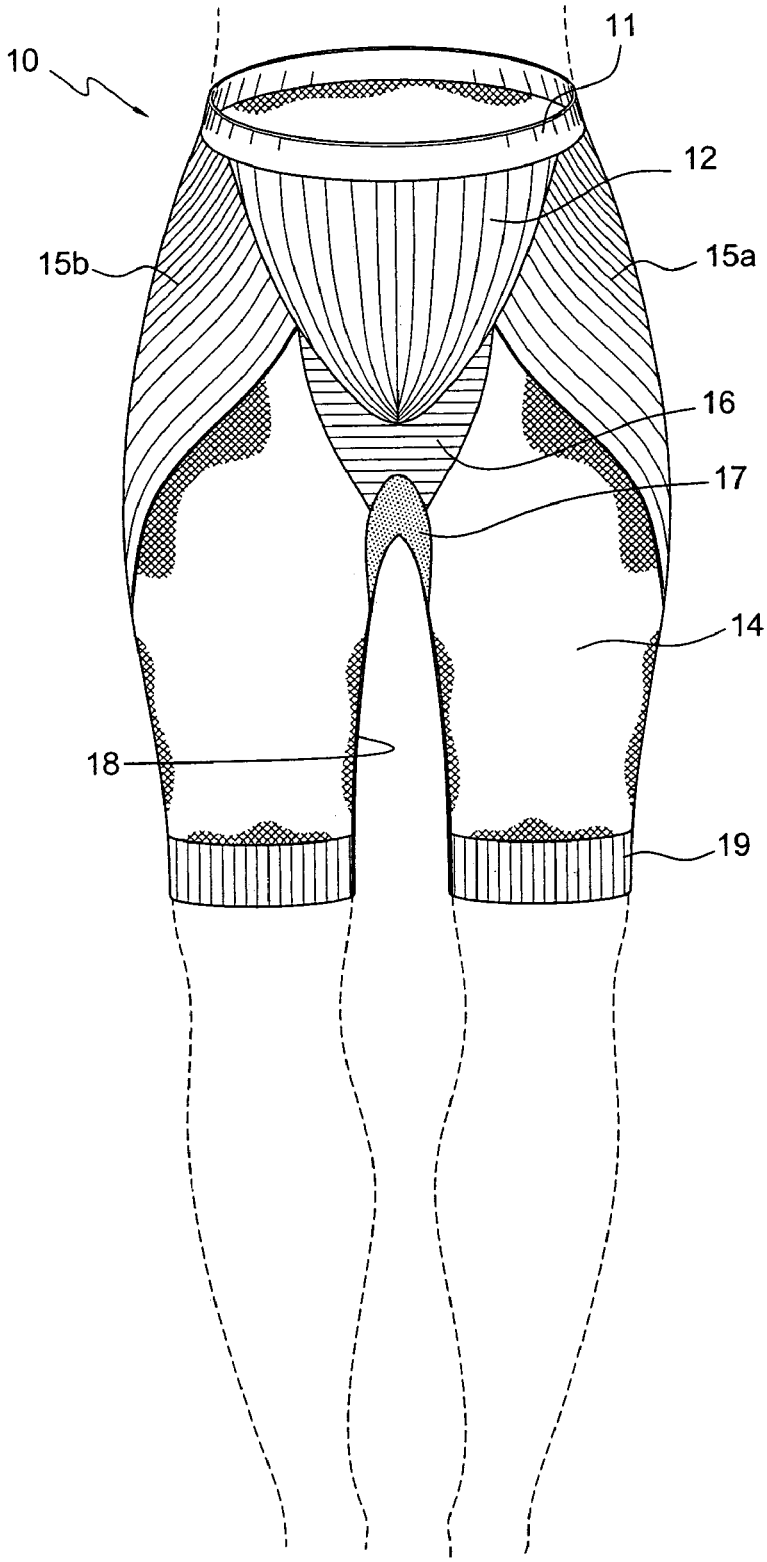
FIG. 1 is an anterior frontal view of the panty on a wearer according to the invention.
Figure 2:
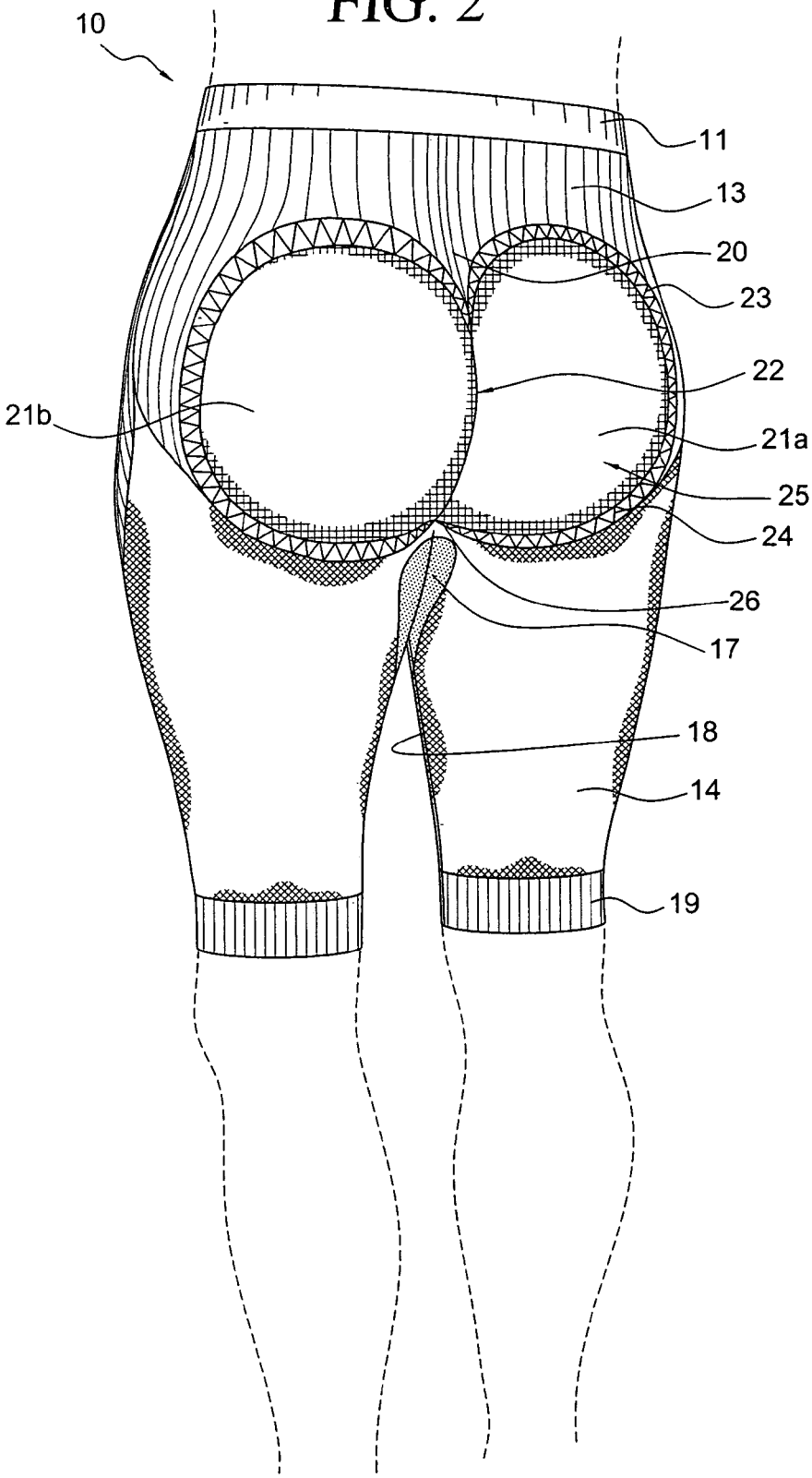
FIG. 2 is a posterior perspective view of the panty of FIG. 1.

Referring now to the drawings, FIGS. 1 and 2 respectively, show the anterior and posterior views of a panty according to the invention as it appears when it is worn. As shown in FIG. 1, the panty garment 10 includes a waist band 11 which is preferably in the form of a reinforced weave. Integrally knit from the band 11 is a circularly knit body region having anterior and posterior regions 12 and 13 respectively, which in turn are integrally knit together along side portions. The panty garment 10 also includes thigh portions 14 which extend from the pelvic bone to the upper thighs of the wearer.

The anterior region 12 and the posterior region 13 are joined at the top edge to the band 11. The anterior region 12 of the garment 10 includes integrally knit-in support panels 12, 15*a*, 15*b* and 16, each of which has a different degree of stretch compared with the remainder of the garment.

Specifically, the first knit-in support panel 12 has the greatest resistance to stretch to provide the heaviest compression for the tummy region. The second and third knit-in support panels 15*a* and 15*b* respectively, are knit integrally from the first knit-in support panel 12, have a ribbed stretch pattern, and overlie the outer hip and thigh saddlebag regions of the wearer's body thereby controlling undesirable bulging in these conventionally bulge prone areas. The anterior first knit-in support panel 12 which controls the tummy bulge extends from the waist to the crotch, and is therefore somewhat triangularly shaped ending into an integrally knit fourth support panel 16 which bridges the lower end of the first knit-in support panel 12 and a gusset 17 sewed in the crotch area. The fourth support panel 16 provides support for the lower tummy area and creates an additional compression point for undesirable bulges. The thigh portions terminate into a ribbed edge 19 which is preferably in the form of a band that does not roll over or squeeze the thigh region. As would be readily appreciated by one having ordinary skill in the art, a variety of garment sizes and knit-in support panel sizes or additional panels could be utilized and are within the scope of the invention.

The anterior and posterior regions of the garment 10 are joined together along seam 18 to form the gusset portion 17 between the thighs 14. The seam 18 may be formed by sewing.

In addition, as shown in FIG. 2, the garment 10 also desirably includes an anchor-shaped fifth knit-in support panel 13 which is positioned from the waist down to the gluteal mound 20, thereby compressing the upper hip region and reducing the appearance of "love handles". Further, the fifth knit-in support panel extends on either side into a ribbing knit pattern to meet the second and third knit-in support panels 15*a* and 15*b* respectively, to support and compress the saddlebag regions of the wearer's body in the thigh region.

FIG. 2 illustrates a sixth knit-in support panel 21*a* and 21*b* integrally knit from fifth knit-in support panel 13 near the gluteal mound region 20, and extending into the gluteal crease 22 to create strategically placed left and right derriere cups 21*a* and 21*b* made of a jersey knit that allows natural rounding of the buttock cheeks. The sixth knit-in support panel uniquely extends vertically through the center posterior region 22, curves on either side to frame the buttock cheeks with a stretchable ruching 23 on the top and a stretchable ruching at the bottom of the derriere cups, thereby providing a natural, round and firmer appearance to the derriere 25.

The sixth support panel integrally extends into support panel seven, said seventh support panel having greater strength and stretch to support the buttock cheeks and lift and firm them into a naturally rounded youthful shape.

Figure 3:
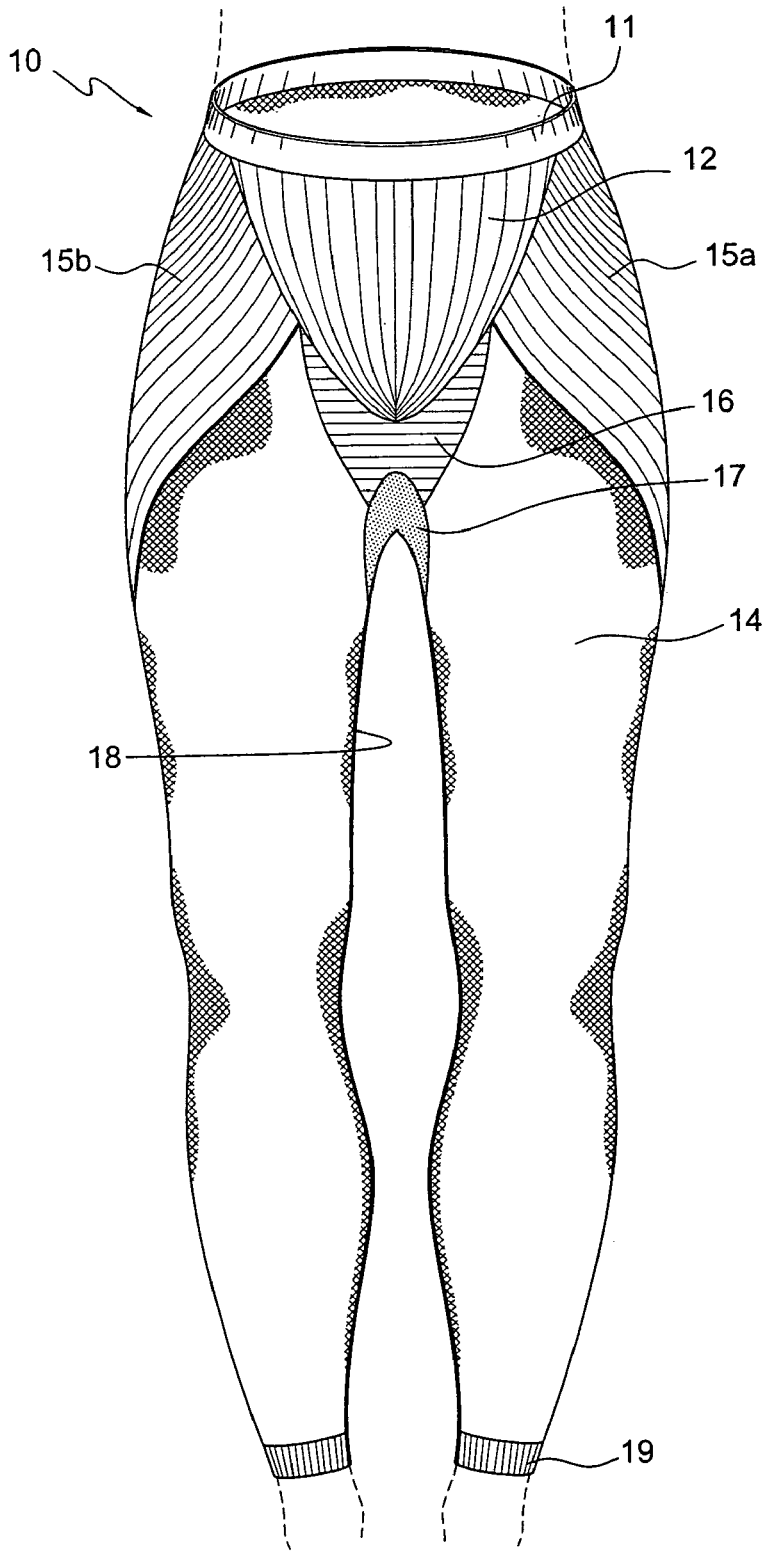
FIG. 3 is an anterior frontal view of the panty hose or legging according to the invention.
Figure 4:
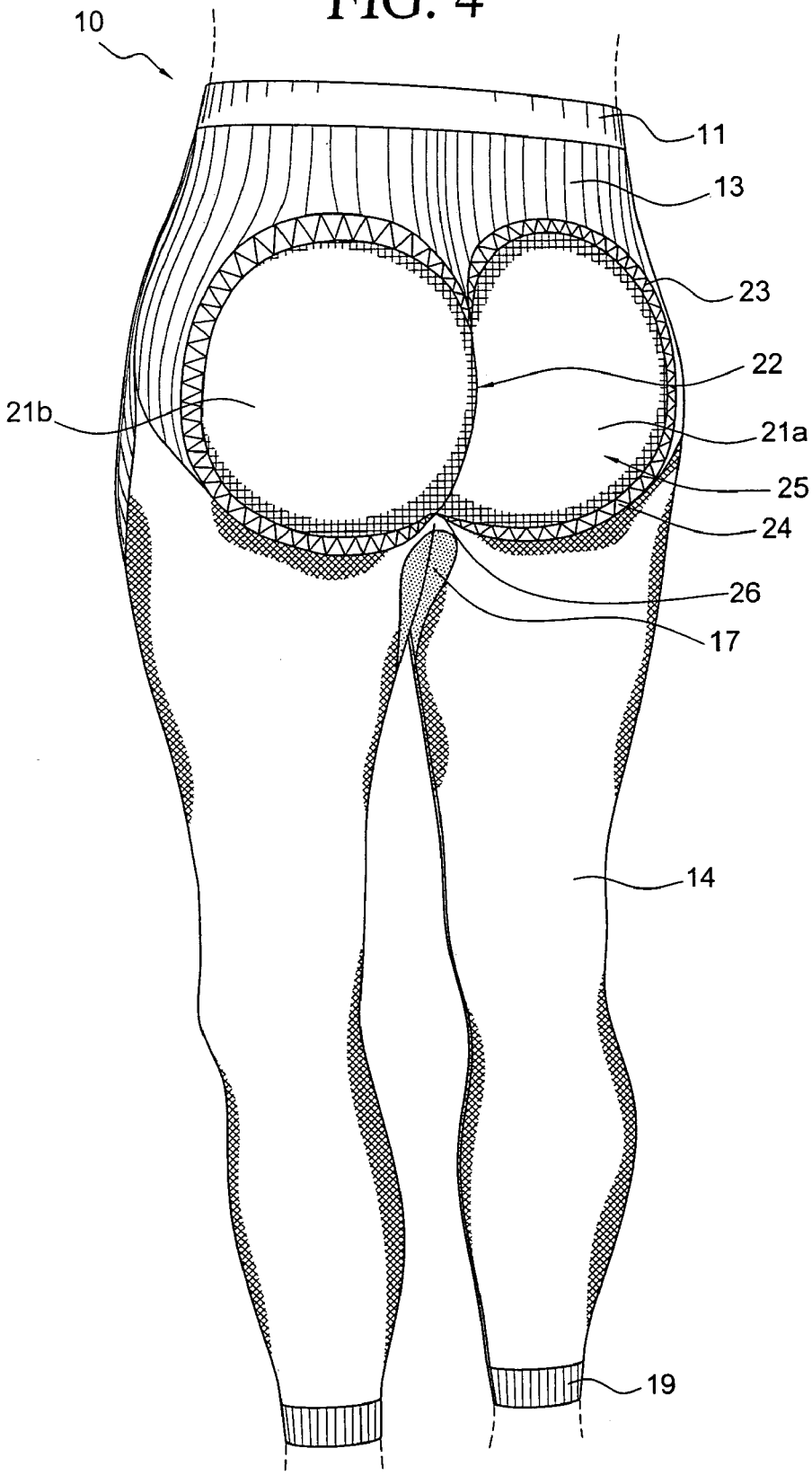
FIG. 4 is a posterior perspective view of the panty hose or legging of FIG. 3.

FIGS. 3 and 4 are the anterior and posterior views of the garment 10 according to the invention having the elements described for FIGS. 1 and 2 respectively. In addition, FIGS. 3 and 4 describe the garment extending into the leg section, and specifically, the thigh portions 14 extending into a stretchable knit any distance from the minor portion of the thigh to the full length of the leg in the manner of leggings, pants or panty hoses.

The present invention is not to be limited in scope by the embodiment disclosed in the example which is intended as an illustration of one aspect of the invention and any methods which are functionally equivalent are within the scope of the invention. Indeed, various modifications of the invention in addition to those shown and described herein will become apparent to those skilled in the art from the foregoing description. Such modifications are intended to fall within the scope of the appended claims. It is realized that other variations and modifications of the preferred embodiment are possible without departing from the scope and spirit of the present invention. Those skilled in the art will recognize, or be able to ascertain using no more than routine experimentation, any equivalents to the embodiments described herein. Such equivalents are intended to be encompassed by the claims.

What is claimed is:

1. A circularly knit undergarment having integrally knit-in support panels, said undergarment comprising:

a waistband defined by a circularly knit ribbed portion reinforced by a seamless hidden fabric layer, a plurality of regions defining anterior and posterior portions integrally knit to said waist band to form a circular body portion, said body portion including first and second leg portions for covering at least a portion of the thighs of a wearer's body when the garment is worn, said anterior portion including a plurality of integrally knit support panels of strengthened knit structure having resistance to compress predetermined portions of a wearer's body, said posterior portion including a plurality of integrally knit support panels and discrete derriere cups located at each side of the gluteal crease to house the buttock cheeks and give them a natural, rounded shape and wherein said anterior portion comprises a first knit-in triangular shaped support panel, said panel having a greater resistance to stretch and located in the tummy region of the wearer.

2. The circularly knit undergarment according to claim 1, further comprising a plurality of second and third knit-in support panels, each of said panels integrally knit to each side of the first knit-in triangular support panel to provide resistance to stretch in the saddlebag region of the hips.

3. The circularly knit undergarment according to claim 1, including a knit-in support panel integrally knit from a lower tip of the triangular first support panel located in the lower tummy region.

4. The circularly knit undergarment according to claim 1, including a fifth knit-in support panel, wherein said panel is substantially anchor-shaped and is located on said posterior portion of said body portion extending from the waist band to the region of the gluteal mound.

5. The circularly knit undergarment according to claim 4, wherein the anchor-shaped panel has a left and right side, each of said sides integrally knit to provide compression for the saddlebag regions of the hips.

* * * * *